US006449778B1

(12) United States Patent
Franco

(10) Patent No.: US 6,449,778 B1
(45) Date of Patent: Sep. 17, 2002

(54) DEVICE FOR EVACUATING INTESTINAL ORGANIC GAS FROM INSIDE WATER CLOSETS TO THE OUTSIDE OF BATHROOMS

(76) Inventor: Alejandro Jose Franco, Calle 1, No. 1788, Santiago del Estero (AR), 4200

( * ) Notice: Subject to any disclaimer, the term of this patent is extended or adjusted under 35 U.S.C. 154(b) by 0 days.

(21) Appl. No.: 09/662,060

(22) Filed: Sep. 15, 2000

(30) Foreign Application Priority Data

Sep. 20, 1999 (AR) ..... P99 01 05 374

(51) Int. Cl.[7] ..... E03D 9/04
(52) U.S. Cl. ..... 4/217; 4/213
(58) Field of Search ..... 4/217, 213, 216, 4/210, 214, 215

(56) References Cited

U.S. PATENT DOCUMENTS 988,273 A * 3/1911 Levenhagen et al. ..... 4/217
1,695,530 A * 12/1928 Bruder ..... 4/217
2,238,461 A * 4/1941 Carman ..... 4/213
3,333,285 A * 8/1967 Null ..... 4/213
3,386,109 A * 6/1968 Christian et al. ..... 4/213
3,599,253 A * 8/1971 Maisch ..... 4/217
3,659,296 A * 5/1972 Stamper ..... 4/217
3,916,459 A * 11/1975 Ivancevic ..... 4/213
4,117,559 A * 10/1978 Boyle ..... 4/213
4,175,293 A * 11/1979 Stephens et al. ..... 4/217
4,232,406 A * 11/1980 Beeghly et al. ..... 4/216
4,301,555 A * 11/1981 Poister ..... 4/213
4,780,913 A * 11/1988 Williams ..... 4/213
5,105,479 A * 4/1992 Ross ..... 4/213
5,638,553 A * 6/1997 Loewen et al. ..... 4/213
5,724,682 A * 3/1998 Johnson ..... 4/217

* cited by examiner

*Primary Examiner*—Charles R. Eloshway
(74) *Attorney, Agent, or Firm*—Wenderoth, Lind & Ponack, L.L.P.

(57) ABSTRACT

A gas evacuating device is provided for evacuating organic intestinal gases from a toilet to outside of a bathroom. The device includes a toilet seat installed on a toilet base, and base or support members for securing the toilet seat to the toilet base at opposing sides of the toilet seat. A rubber joint member is disposed between the seat and the base of the toilet and has openings therein. The toilet seat is provided with channels in which filters are disposed, and holes leading from the toilet interior to the channels. Passages are provided in the seat and the base members to connect the channels to a hose and a gas extractor.

15 Claims, 5 Drawing Sheets

4
2
2
1
6
19
I
I
21
5
22
4
II
II
23
6
7
3
8

Fig.4
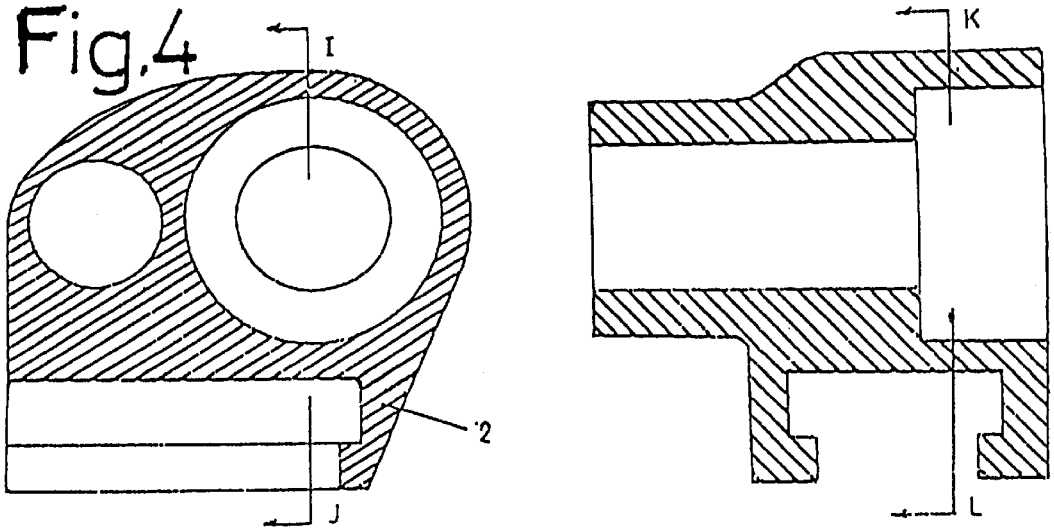
Fig.5
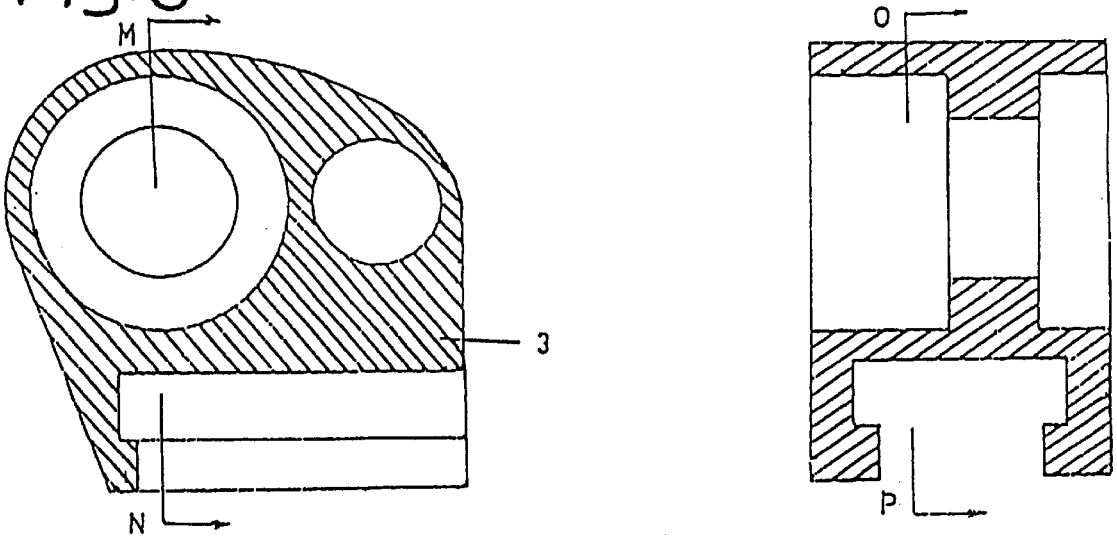
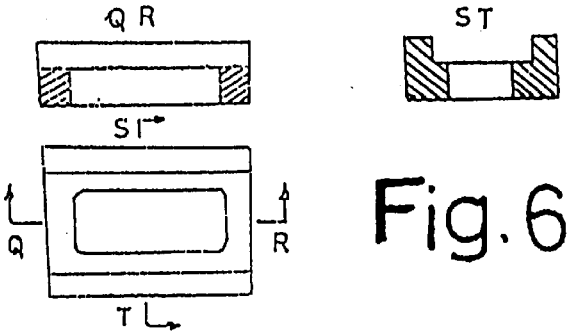
Fig.6

DEVICE FOR EVACUATING INTESTINAL ORGANIC GAS FROM INSIDE WATER CLOSETS TO THE OUTSIDE OF BATHROOMS

BACKGROUND OF THE INVENTION

The technical field of the invention corresponds to Sanitary Engineering. Specifically, it relates to toilets used in family homes, offices, hotels, hospitals, vessels, schools, shops, cinemas, etc.

PRIOR ART

Use of a toilet with a hydraulic trap closure (preventing passage of gas from sewerage pipes into the bathroom) has been mandatory in England since the year 1848, and was then adopted gradually by all civilized countries (ESPASA Encyclopaedia, Barcelona, Spain, Volume XXVIII, page 1671).

However, up to now, intestinal organic gas accompanying any human evacuation into a toilet has spread into the bathroom and even to surrounding areas.

This fetid gas and miasma are smelt by all persons in spite of the unpleasant and depressing sensation they cause. This condition is even worse in the event of intestinal problems suffered by some individuals (such as constipation, chronic gastritis, etc.). If this situation happens in poorly ventilated rooms, the development of the so-called "swamp miasmatic fever" may begin to occur, which in spite of being transitory, causes migraines (serious headaches).

In some cases, these bad smells are "dissimulated" using aerosol deodorants and other similar resources, but with poor practical results. In places such as public baths and industrial plants, the attempts to eliminate these smells involve the use of high air extractors. None of these attempted solutions prevents the major portion of the very fine miasma particles (having low oxygen content and a high proportion of methane and carbonic gas) from entering the lungs.

Taking into account the above stated as regards the present state of the art, it is clear that no method, process or system exists for removing organic gas from inside the toilets to the outside of bathrooms before such gas is spread throughout the room.

SUMMARY OF THE INVENTION

The present invention was developed to solve the above-mentioned problems of the prior art and is embodied as an organic gas evacuating device for evacuating intestinal organic gas from a toilet to outside a bathroom. It consists basically of a type of seat for a toilet and of two types of support or base members as well as a pivot part for the seat. These three elements are designed in order to allow passage of gaseous fluids through their bodies. The invention likewise includes a rubber valve for security against occurrence of a vacuum within the toilet. The system is completed with an exhaust device (or extractor) for organic gas, a hose and a switch with a device for automatic disconnection. These three last elements are conventional elements.

The extractor sucks and extracts organic gas from the toilet through the openings and filters existing in the lower part of the seat. The gas passes through hollows existing in the seat (1) and base (2), continues along the hose (9) and is expelled through the ventilation hose (15) to the exterior of the bathroom.

We human beings still have some basic physiological needs which are at the same level of those of animals. This novel organic gas evacuation system for evacuating gases from the interior of toilets before they may spread into the environment constitutes a small new step separating us further within the zoological range. Taking into account that all persons which had to bear with resignation the repulsive bad smells of intestinal evacuations as from the times of the caves, without the present state of the art offering any method or system to eliminate organic gas from the interior of toilets before they spread within the environment of the bathroom, this invention constitutes something absolutely advantageous, useful and necessary.

This new system for evacuating organic gas prevents spreading of the gas into bathrooms. Therefore it will reduce the need of using aerosol deodorants and so the attack to the ozone layer will also be reduced, thus obtaining an improvement within the world biosphere.

BRIEF DESCRIPTION OF THE DRAWINGS

FIG. 4 shows a detail of a support or base (2).

FIG. 5 shows a detail of another support or base (3).

FIG. 6 shows adjustable fixing slides for the supports or bases (2) and (3).

DETAILED DESCRIPTION OF THE INVENTION

Figure 1:
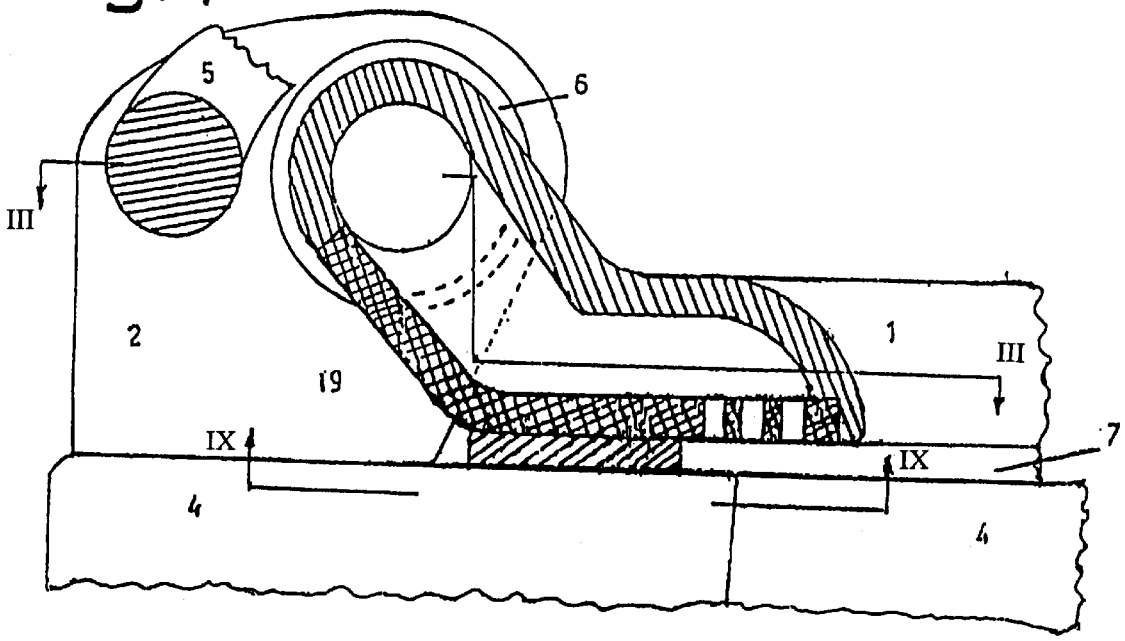
FIG. 1 is a cross section view of a seat (1) taken along line I—I of FIG. 3 (hollow part) for an organic gas evacuation device of the present invention.
Figure 2:
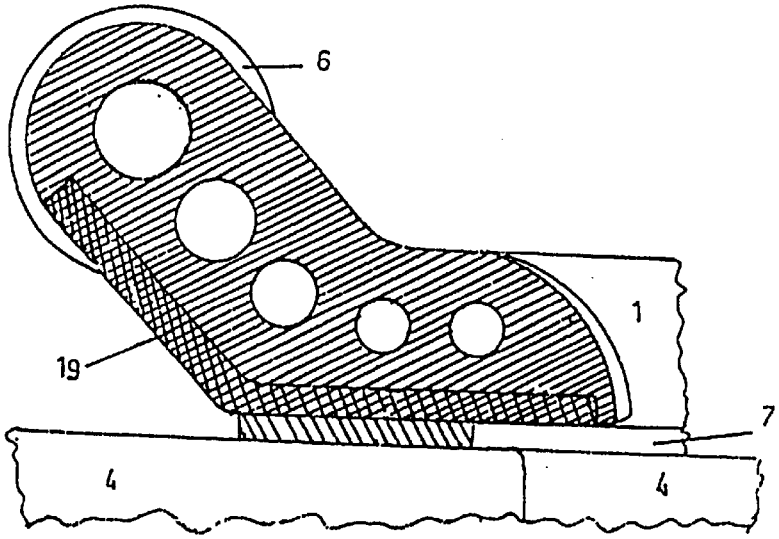
FIG. 2 is another cross section view of the seat (1) taken along line II—II of FIG. 3 (part with ribs).

This invention consists of a device for evacuating intestinal organic gas from inside the toilets to the outside of bathrooms. The gas evacuating device is constructed as follows.

A toilet seat (1), is designed with a gas passage for allowing passage of organic gas to the outside. A support or base member (2) is provided for supporting the seat (1) at another side, and is designed to allow passage of organic gas to the outside. It has an end adapted for attaching a hose. A support or base member (3) is provided for supporting the seat (1) at another side, and is designed to allow passage of air from the outside through a vacuum release valve (8) incorporated therein (discussed below). The vacuum release valve (8) is preferably rubber and has a virtual cross opening designed as a safety feature for avoiding occurrence of a vacuum inside the toilet in case of total closure on the seat (1). This may be the case with very fat users and/or blockage of openings (18, FIG. 8) by clothes.

Figure 3:
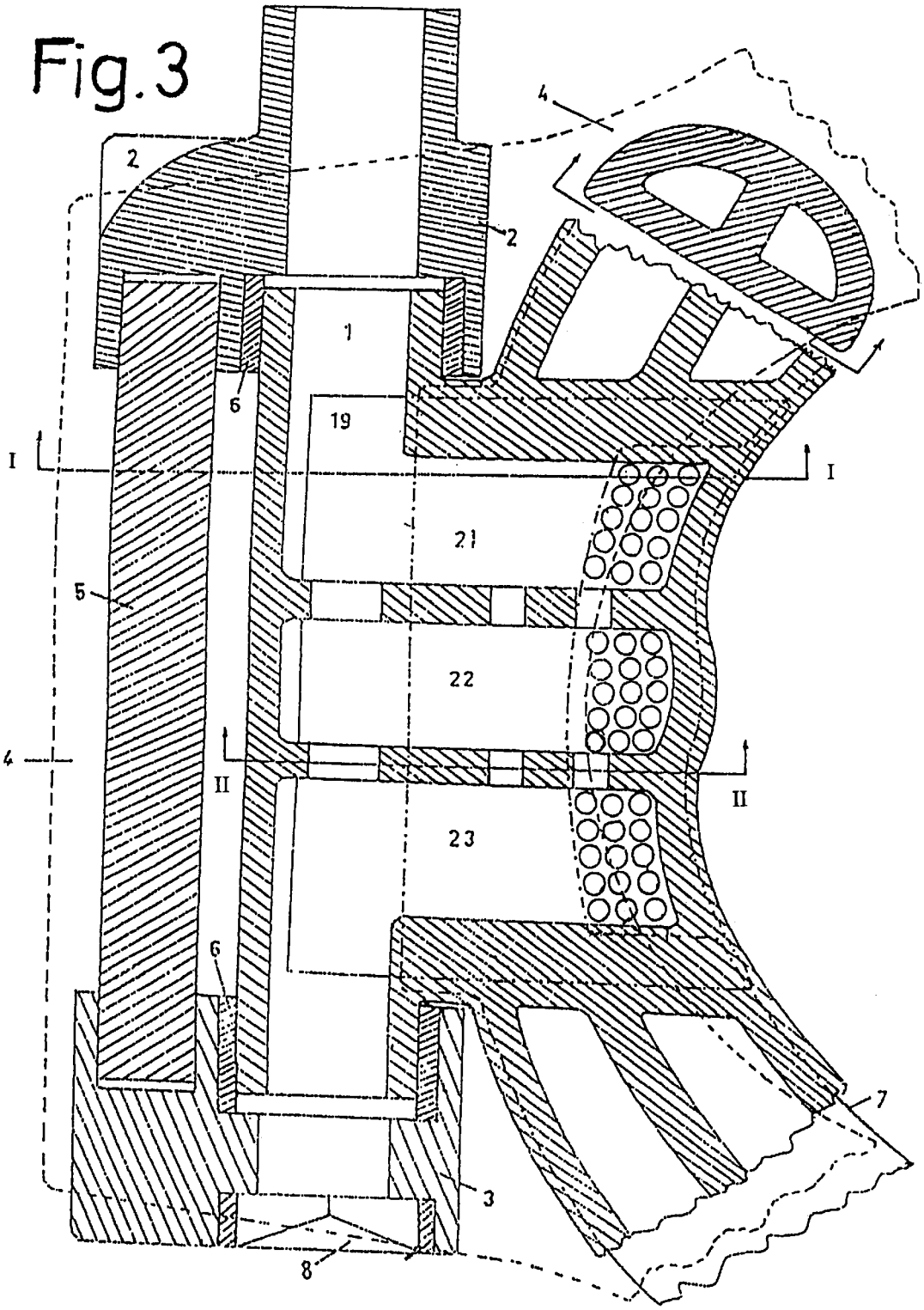
FIG. 3 is a view of the principal part of this invention, through section line III—III of FIG. 1.
Figures 7, 8:
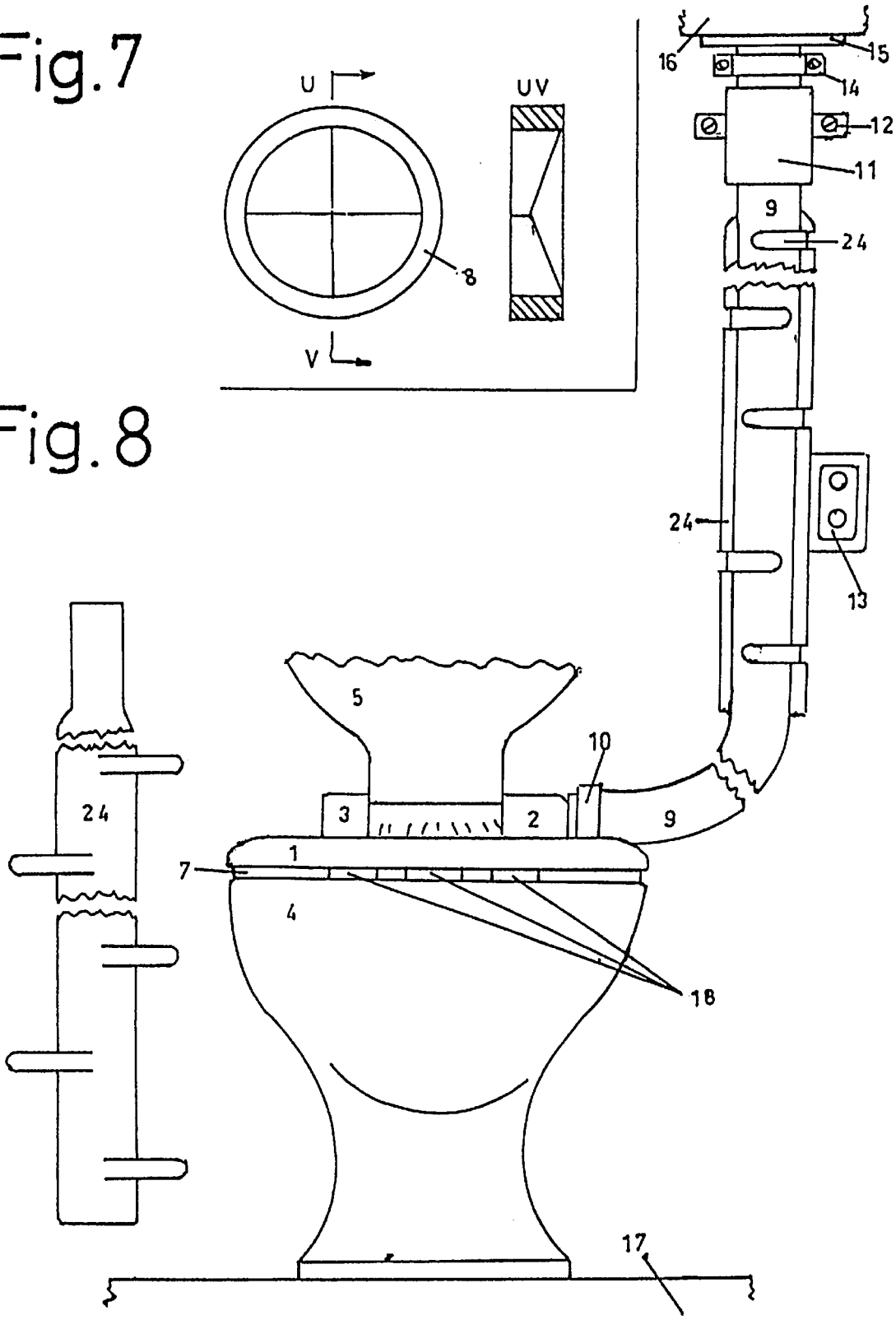
FIG. 7 shows a rubber valve (8) with a virtual cross opening.
FIG. 8 shows a general installation sketch for explanation of the installation and operation of the organic gas evacuation device from the interior of the toilet.
Figure 9:
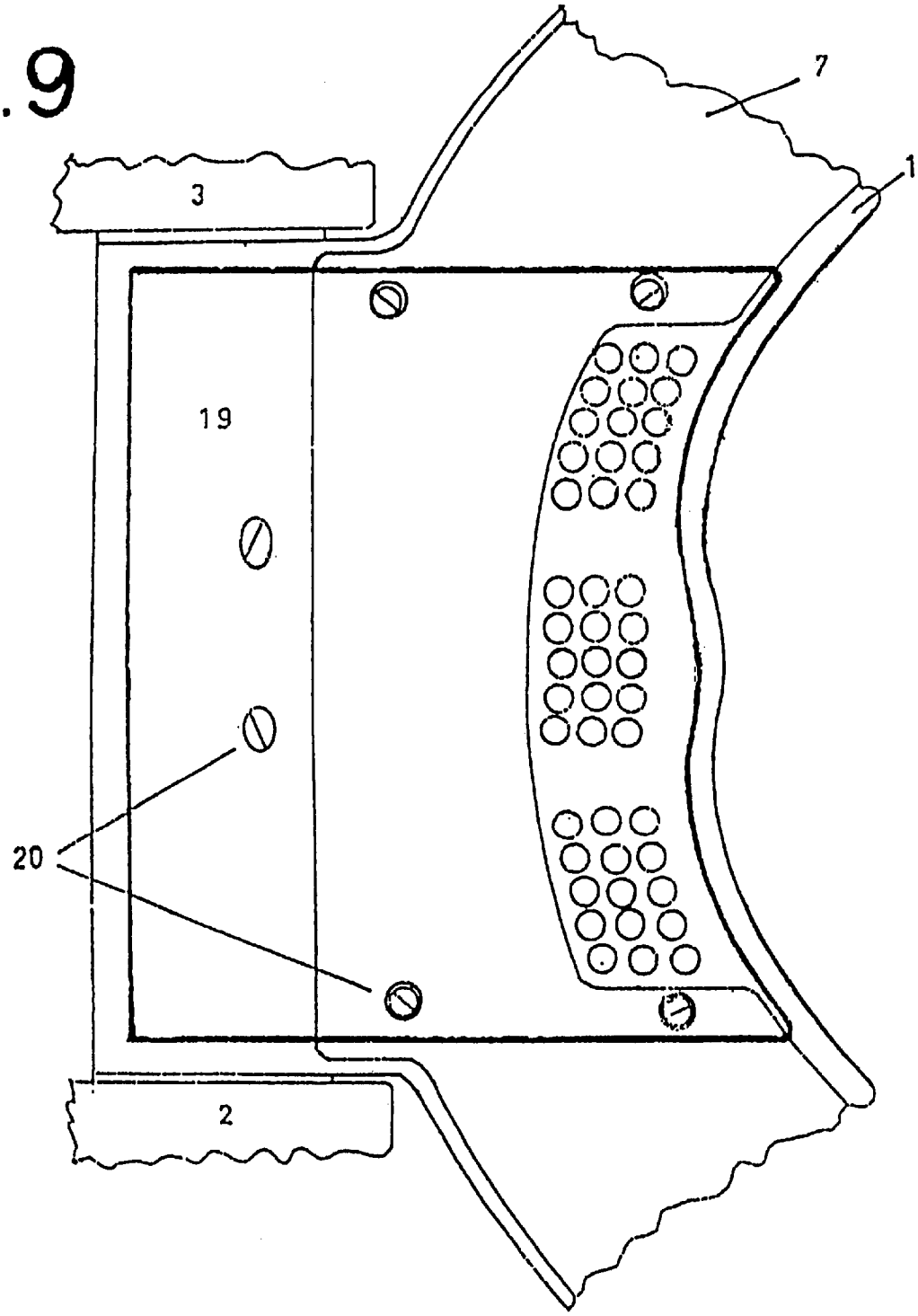
FIG. 9 shows a view along section IX—IX of FIG. 1, in which we see a special part (19) with fixing bolts (20), the seat (1) and a part of a joint (7) glued to its body (but with two lateral cuts separating the rest of the joint).

A rubber air inlet-limiting joint (or joining member) (7) is provided between the toilet base (4) and the toilet seat as a base for the seat (1), such as may be seen in FIG. 3 in the dotted lines. As shown in FIG. 8, openings (18) of the joint (7) allow air passage from the front of the toilet for dragging gas through an extractor (11) (discussed below). Two rubber bushings (6) are located at the support or base members (2) and (3). They serve for dampening shocks caused by the seat (1) when lowered and for avoiding air intake through this portion. Two broad regulation conventional slides (FIG. 6) are provided for fixing support or base members (2) and (3). Square head screws are not shown since they are obvious.

As shown best in FIG. 8, a conventional rubber hose (9) is provided for passage of organic gas to the outside of the bathroom. A conventional electro-mechanical extractor (or gas exhaust device) (11) is connected to the hose (9) for suction and exhaust of gas to the outside. An electric switch (13) is provided for turning the extractor (11) on and off It has a timer for automatically turning the extractor off after a predetermined time in case the user forgets to turn it off. The toilet bowl (4) may already exist in the bathroom, and include toilet lid (5).

As shown in FIG. 3, three filters of stainless steel or bronze wool, for preventing passage of particles of toilet paper, cotton, threads, hairs, miasma, etc., are placed at the seat (1) within channels 21, 22 and 23.

As shown in FIGS. 1–3 and 9, a cover (19) has holes for passage of organic gas to the exhaust system. This cover part (19) in turn serves for enclosing the filters and, as illustrated, is removable for effecting periodic inspection and cleaning of the filters. (Details in FIG. 9).

As shown in FIG. 8, a support part (24) made of rubber or plastic supports and holds the hose (9). This support part (24) is to be attached to the bathroom wall by a strong adhesive. Further, it will be firmly fitted against the wall by clamp (14) and a base (12) of the extractor (11) on a high portion of the wall. The use of the support part (24) avoids use of the fixing screws on the low area of the wall, since water pipes normally pass through this part and there exists the possibility that they be perforated if fixing screws are used in this area. Clamps of this part will be held on the hose (9) by means of the same strong adhesive. This adhesive may also be used for fixing the switch base (13) on the wall. This part will not be required if the user decides to place the hose (or tubing) inside the wall. This will also occur in new buildings.

The operation of the present invention will now be described. Before sitting on the toilet, the user should turn the extractor on. The start button should be placed at the user's hand or near the elbow when the user is sitting on the toilet, to facilitate operation by elderly people who could forget to start the device and would otherwise have to stand up to turn the extractor on.

The extractor (11) suctions and removes organic gas from the toilet through the holes and filters existing in the lower part of the seat (1), as shown in FIGS. 1 and 3. Then, gas passes through the hollow axis of seat (1), continue their route through the support or base (2) which has a passage hole and a proper end for fixing hose (9), pass through extractor (11) which drives gas through the upper portion of the hose (9) until they are exhausted through the ventilation duct (15) to the outside of the bathroom.

What is claimed is:

1. A gas evacuation device for use with a toilet having a toilet bowl, comprising:

a toilet seat arranged for mounting to the toilet bowl, said toilet seat having a gas passage therein and holes in its underside leading into said gas passage for communicating said gas passage with an interior of the toilet bowl;

at least one base member for mounting said toilet seat to the toilet bowl;

a gas outlet adapted for connection to a gas outlet conduit for carrying gasses from the interior of the toilet bowl via said gas passage away from the toilet; and an air inlet and a vacuum releasing valve for automatically allowing air intake to said gas passage upon occurrence of a vacuum in the interior of the toilet bowl and in said gas passage of said toilet seat.

2. A gas evacuation device according to claim 1, wherein said at least one base member comprises first and second base members;

said gas outlet is provided in said first base member; and said air inlet and said vacuum releasing valve are provided in said second base member.

3. A gas evacuation device according to claim 1, wherein said toilet seat includes a pivot part received by said at least one base member to provide for pivoting of said toilet seat relative to the toilet bowl about a pivot axis; and said gas outlet is axially aligned with said pivot part and opens in a first axial direction of said pivot part, and said air inlet is axially aligned with said pivot part and opens in a second axial direction opposite said first axial direction.

4. A gas evacuation device according to claim 1, wherein said gas passage of said toilet seat comprises a plurality of filter channels having a plurality of filters respectively disposed therein for preventing passage of particles through said gas outlet.

5. A gas evacuation device according to claim 4, wherein said filter channels are elongated and extend generally in a front to rear direction of said toilet seat.

6. A gas evacuation device according to claim 4, wherein said toilet seat further includes a main part and a cover member having said holes formed therein, said cover member being removably secured to an underside of said main part so as to cover an underside of said filter channels and allow for inspection and cleaning of said filters.

7. A gas evacuation device according to claim 1, further comprising an electro-mechanical gas extractor operably connected to said gas outlet for drawing gas from said gas outlet;

an actuation switch for actuating said electro-mechanical gas extractor; and an automatic de-activation part for automatically turning said electro-mechanical gas extractor off after a period of time.

8. A gas evacuation device according to claim 1, further comprising said gas outlet conduit connected to said gas outlet;

a wall support part for supporting said gas outlet conduit to a wall; and an adhesive for adhering said wall support part to the wall.

9. A gas evacuation device according to claim 1, further comprising an air inlet-limiting joining member disposed about an underside of said toilet seat and having openings therein, for limiting air intake into the interior of the toilet bowl from between said toilet seat and the toilet bowl.

10. A gas evacuation device according to claim 1, wherein said vacuum releasing valve comprises a rubber valve having a cross-shaped opening.

11. A gas evacuation device for use with a toilet having a toilet bowl, comprising:

a toilet seat arranged for mounting to the toilet bowl, said toilet seat having a gas passage therein and holes in its underside leading into said gas passage for communicating said gas passage with an interior of the toilet bowl;

at least one base member for mounting said toilet seat to the toilet bowl;

a gas outlet adapted for connection to a gas outlet conduit for carrying gasses from the interior of the toilet bowl via said gas passage away from the toilet;

air inlet-limiting joining member disposed about an underside of said toilet seat; and an air inlet and a vacuum releasing valve for automatically allowing air intake to said gas passage upon occurrence of a vacuum in the interior of the toilet bowl and in said gas passage of said toilet seat;

wherein said gas passage of said toilet seat comprises a plurality of filter channels having a plurality of filters respectively disposed therein for preventing passage of particles through said gas outlet.

12. A gas evacuation device according to claim 11, wherein said filter channels are elongated and extend generally in a front to rear direction of said toilet seat.

13. A gas evacuation device according to claim 11, further comprising an electro-mechanical gas extractor operably connected to said gas passage of said toilet seat for drawing gas therefrom;

an actuation switch for actuating said electro-mechanical gas extractor; and an automatic de-activation part for automatically turning said electro-mechanical gas extractor off after a period of time.

14. A gas evacuation device according to claim 11, wherein said air inlet-limiting joining member has openings therein, for limiting air intake into the interior of the toilet bowl from between said toilet seat and the toilet bowl.

15. A gas evacuation device according to claim 11, wherein said toilet seat includes a pivot part received by said at least one base member to provide for pivoting of said toilet seat relative to the toilet bowl about a pivot axis; and said gas outlet is axially aligned with said pivot part and opens in a first axial direction of said pivot part, and a gas inlet is axially aligned with said pivot part and opens in a second axial direction opposite said first axial direction.

* * * * *